US009310742B2

(12) United States Patent
Shirafuji

(10) Patent No.: US 9,310,742 B2
(45) Date of Patent: Apr. 12, 2016

(54) IMAGE FORMING APPARATUS THAT UPDATES PROCESS CONDITION OF IMAGE FORMATION

(71) Applicant: CANON KABUSHIKI KAISHA, Tokyo (JP)

(72) Inventor: Yasuhito Shirafuji, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/516,747

(22) Filed: Oct. 17, 2014

(65) Prior Publication Data

US 2015/0117885 A1 Apr. 30, 2015

(30) Foreign Application Priority Data

Oct. 25, 2013 (JP) ..... 2013-222683

(51) Int. Cl.
*G03G 15/00* (2006.01)
*G03G 21/20* (2006.01)

(52) U.S. Cl.
CPC ..... *G03G 15/5062* (2013.01); *G03G 15/5041* (2013.01); *G03G 21/20* (2013.01)

(58) Field of Classification Search
CPC ..... G03G 15/5062
USPC ..... 399/49
See application file for complete search history.

(56) References Cited

U.S. PATENT DOCUMENTS

| | | | | |
|---|---|---|---|---|
| 8,229,307 | B2 | 7/2012 | Komiya | |
| 8,532,511 | B2 | 9/2013 | Komiya | |
| 2008/0131152 | A1 | 6/2008 | Komiya | |
| 2008/0159763 | A1* | 7/2008 | Nakane | 399/49 |
| 2010/0008681 | A1* | 1/2010 | Nagatsuka | 399/43 |
| 2012/0263484 | A1 | 10/2012 | Komiya | |
| 2013/0266331 | A1* | 10/2013 | Suzuki | 399/49 |

FOREIGN PATENT DOCUMENTS

JP 2008-139588 A 6/2008

OTHER PUBLICATIONS

U.S. Appl. No. 14/535,530, filed Nov. 7, 2014.

* cited by examiner

*Primary Examiner* — Quana M Grainger
(74) *Attorney, Agent, or Firm* — Fitzpatrick, Cella, Harper & Scinto

(57) ABSTRACT

An image forming apparatus includes: an update unit configured to cause an image forming unit to form a first measurement image, to cause a measurement unit to measure the first measurement image, and to update a process condition based on a measurement result; a first determination unit configured to cause the image forming unit to form a plurality of second measurement images, to cause the measurement unit to measure the plurality of second measurement images, and to determine the process condition based on a measurement result, the plurality of second measurement images being formed according to a plurality of test process conditions; and a second determination unit configured to determine the plurality of test process conditions, based on environment information obtained by an obtainment unit and the process condition updated by the update unit.

14 Claims, 10 Drawing Sheets

IMAGE FORMING APPARATUS THAT UPDATES PROCESS CONDITION OF IMAGE FORMATION

BACKGROUND OF THE INVENTION

1. Field of the Invention

The present disclosure relates to a density control technique in an image forming apparatus.

2. Description of the Related Art

An image forming apparatus using an electrophotographic scheme is required to have output-image-density stability and the like. US2008/0131152 discloses a technique of forming a test pattern on a recording material using each of a plurality of values of an image forming condition (process condition), to determine an image forming condition that achieves a target density. In US2008/0131152, the range of values of the image forming condition used when forming the test pattern is predetermined.

The diversification of the use environment of users and the printing mode can cause a situation where the target density is not included in the density range of the test pattern formed using the image forming condition in the predetermined range. In such a case, the image forming condition cannot be determined accurately. On the other hand, excessively widening the range of values of the image forming condition to be used so that the target density is included in the density range of the test pattern can lead to lower accuracy of density control.

SUMMARY OF THE INVENTION

According to an aspect of the present invention, an image forming apparatus includes: an image forming unit configured to form an image according to a process condition; a measurement unit configured to measure a measurement image formed by the image forming unit; an update unit configured to cause the image forming unit to form a first measurement image, to cause the measurement unit to measure the first measurement image, and to update the process condition based on a result of the measurement of the first measurement image by the measurement unit; a first determination unit configured to cause the image forming unit to form a plurality of second measurement images, to cause the measurement unit to measure the plurality of second measurement images, and to determine the process condition based on a result of the measurement of the plurality of second measurement images by the measurement unit, the plurality of second measurement images being formed according to a plurality of test process conditions; an obtaining unit configured to obtain environment information; and a second determination unit configured to determine the plurality of test process conditions, based on the environment information obtained by the obtaining unit and the process condition updated by the update unit.

Further features of the present invention will become apparent from the following description of exemplary embodiments with reference to the attached drawings.

DESCRIPTION OF THE EMBODIMENTS

The following describes exemplary embodiments of the present invention with reference to drawings. Structural elements not necessary for the description of the embodiments are omitted from the drawings. The embodiments described below are merely illustrative, and the present invention is not limited to these embodiments.

[Embodiment 1]

Figure 1:
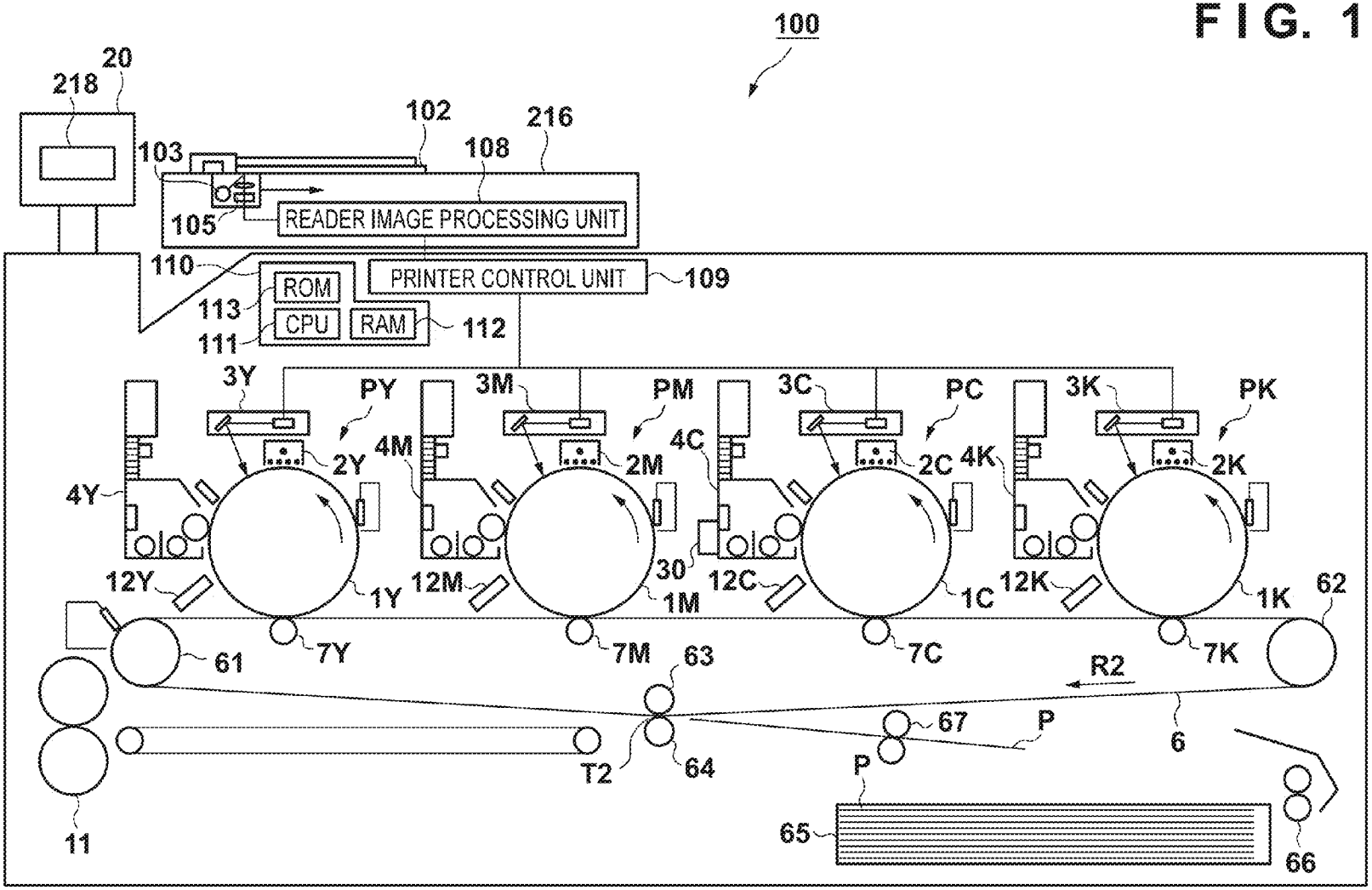
FIG. 1 is a diagram showing an image forming apparatus according to an embodiment.

FIG. 1 is a diagram showing an image forming apparatus 100 according to this embodiment. In the image forming apparatus 100 in FIG. 1, image forming units PY, PM, PC, and PK of yellow, magenta, cyan, and black, respectively, are arranged along an intermediate transfer belt 6. In the image forming unit PY, a photosensitive member 1Y is rotated in the direction of the arrow in the drawing, and charged to a predetermined potential by a charging unit 2Y. An exposure unit 3Y scans and exposes the photosensitive member 1Y with light, to form an electrostatic latent image on the surface of the photosensitive member 1Y. A developing unit 4Y outputs a developing bias to supply yellow toner (coloring material) to the electrostatic latent image on the photosensitive member 1Y, to visualize the image as a toner image. A primary transfer roller 7Y outputs a primary transfer bias, to transfer the toner image formed on the photosensitive member 1Y to the intermediate transfer belt 6. The image forming unit PY also includes a density sensor 12Y for detecting the density of the toner image formed on the photosensitive member 1Y. For example, the density sensor 12Y irradiates the photosensitive member 1Y with light, and measures/detects the density from regular reflection light reflected therefrom.

The image forming units PM, PC, and PK have the same arrangement as the image forming unit PY except that the color of the toner used is different, and as a result, the description of the image forming units PM, PC, and PK is omitted. In the following description, the reference signs without Y, M, C, and K at the end are used in the case where the colors need not be distinguished. The toner images formed on the photosensitive members 1 of the respective image forming units are transferred to the intermediate transfer belt 6 in a superimposed manner, as a result of which a multicolor toner image is formed on the intermediate transfer belt 6.

The intermediate transfer belt 6 extends between three rollers 61, 62, and 63, and is rotated in the direction of R2 in the drawing. A recording material P extracted from a cassette 65 is conveyed toward a secondary transfer point T2, composed of the roller 63 and a secondary transfer roller 64, by roller pairs 66 and 67. At the secondary transfer point T2, the toner image transferred to the intermediate transfer belt 6 is transferred to the recording material P. A fixing unit 11 applies heat and pressure to the recording material P, to fix the toner image. The recording material P is then ejected outside the apparatus.

A light source 103 in a reading unit 216 irradiates a recording material placed on a platen 102 with light. A CCD sensor 105 receives reflection light, to read an image on the recording material. A reader image processing unit 108 and a printer control unit 109 perform predetermined image processing on the image data read by the CCD sensor 105. The image forming apparatus 100 in this embodiment is capable of printing not only an image read by the reading unit 216, but also image data received via a phone line (fax) or image data received from a computer via a network. An operation unit 20 includes a display unit 218 for operating the image forming apparatus 100 by the user and displaying the state of the image forming apparatus 100 to the user. A control unit 110 integrally controls the image forming operation by the image forming apparatus 100, and includes a CPU 111, a RAM 112, and a ROM 113. The control unit 110 determines/obtains density information of the toner image formed on the photosensitive member 1, based on the signal from the density sensor 12. The CPU 111 controls the image forming apparatus 100 using programs and various data held in the ROM 113, with the RAM 112 as a work area. The CPU 111 executes these programs, thus realizing a determination unit that determines a range of values of an image forming condition used in density control and a correction unit that corrects, in correction control, the value of the image forming condition determined by the determination unit, as described later. The image forming apparatus 100 also includes an environment sensor 30 for obtaining environment information in the image forming apparatus, such as at least one of the temperature and the humidity, and notifying the control unit 110 of the environment information.

Figure 2:
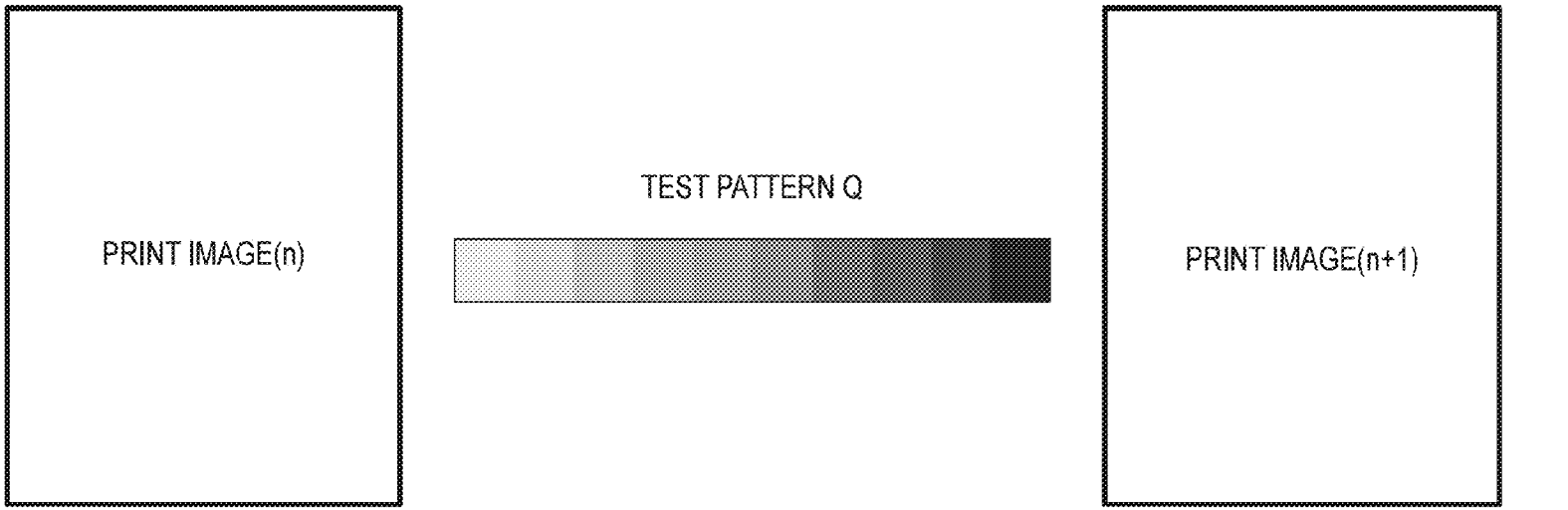
FIG. 2 is a diagram showing a test pattern in a correction control mode according to an embodiment.

The following describes density control in this embodiment. The density control is performed for each color. In this embodiment, the density control is executed according to an operation by the user or when a predetermined condition is satisfied. In the density control, a toner image is formed on a recording material and fixed to the recording material, and the fixed toner image is read by the reading unit 216 to determine the density-related image forming condition. The value (hereafter referred to as "maximum density condition value") of the image forming condition (process condition) for forming an image of desired maximum density (hereafter referred to as "target maximum density") and a tone correction table for converting the value of input image data to achieve the target density are created in the density control. The created tone correction table is used to form a test pattern Q as a measurement image on the photosensitive member 1, using the determined maximum density condition value. The test pattern Q is a pattern having images of a plurality of levels of density (tone) including a solid part (maximum density part), as shown in FIG. 2. The image forming apparatus 100 measures the density of the test pattern Q using the density sensor 12, and obtains target density information indicating the relationship between the value of image data used to form the test pattern Q and the density of the image formed on the photosensitive member 1 using the value.

After this, each time a predetermined number of sheets pass through during continuous image formation, the image forming apparatus 100 in this embodiment transitions to a state called "correction control mode". In the correction control mode, the test pattern Q shown in FIG. 2 is formed on the photosensitive member 1, and the density of the test pattern Q is detected by the density sensor 12. In the correction control mode, the test pattern Q is formed in an area between print toner images on the photosensitive member 1, as shown in FIG. 2. The control unit 110 compares each density level of the target density information obtained in the density control with each detected density level of the test pattern Q. Based on the comparison result, the control unit 110 corrects the maximum density condition value and the tone correction table determined in the density control. The image forming apparatus 100 uses the corrected maximum density condition value and tone correction table, in the subsequent image formation.

The density control is described in detail below, with reference to FIG. 3. In step S10, the control unit 110 forms a test pattern as a measurement image on a recording material, using image data of the value indicating the maximum density. FIG. 4A shows an example of the test pattern formed in step S10. For example, the test pattern shown in FIG. 4A is formed while changing the density-related image forming condition using the value of 255 indicating the maximum density in the case where the image data is 8 bits. Though the image forming condition changed to control the density is the exposure amount (exposure intensity) in the following description, any other density-related image forming condition, e.g. a value for changing developing contrast, such as a developing bias or a charging bias, may be changed. Moreover, a plurality of density-related image forming conditions may be changed. The user sets the recording material on which the test pattern is formed, in the reading unit 216. In step S11, the control unit 110 causes the reading unit 216 to read the test pattern, to detect the density. In step S12, based on the detected density, the control unit 110 determines the maximum density condition value, that is, the value of the image forming condition that enables a toner image, formed using the value of image data indicating the maximum density, to have the target maximum density. In this example, the image forming condition is the exposure amount as mentioned above.

Figure 4A:
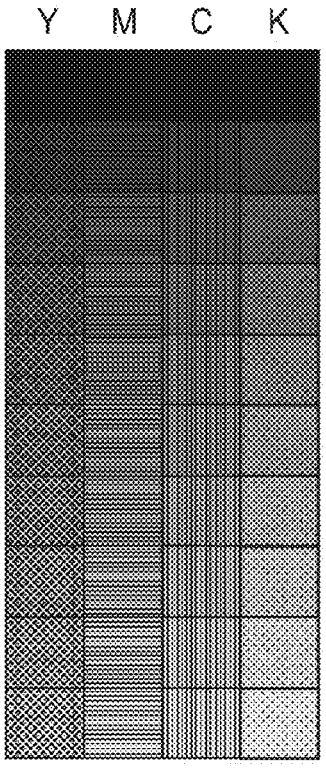
FIGS. 4A and 4B are each a diagram showing a test pattern in density control according to an embodiment.
Figure 4B:
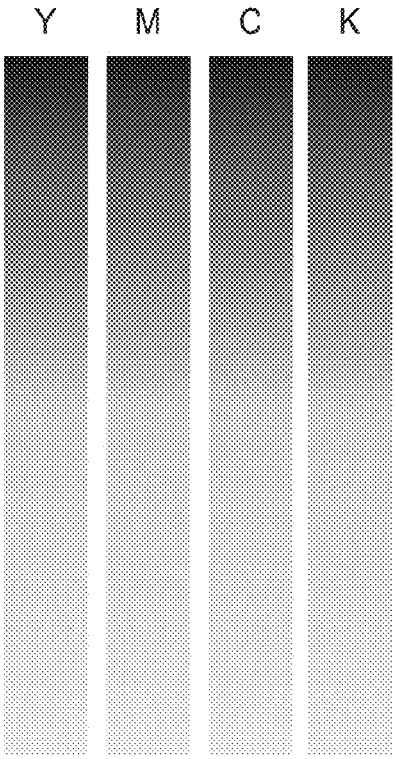
Figure 5:
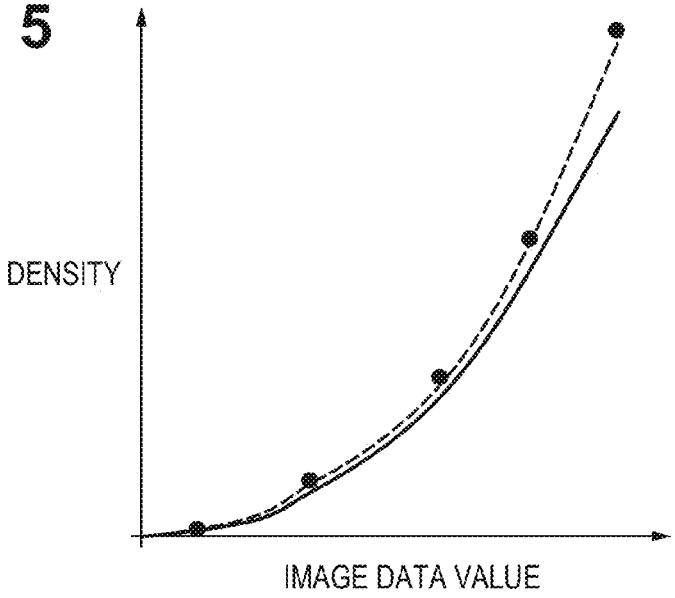
FIG. 5 is a diagram for describing density control according to an embodiment.

Next, in step S13, the control unit 110 forms a test pattern for tone correction, on a recording material. FIG. 4B shows an example of the test pattern formed in step S13. For example, the test pattern shown in FIG. 4B is formed using a plurality of values selected from values ranging from 0 to 255, in the case where the image data is 8 bits. The user sets the recording material on which the test pattern is formed, in the reading unit 216. In step S14, the control unit 110 causes the reading unit 216 to read the test pattern, to detect the density. In step S15, the control unit 110 creates a tone correction table based on the detected density. After this, in step S16, the control unit 110 forms the test pattern Q shown in FIG. 2 on the photosensitive member 1, using image data of a predetermined plurality of values. In step S17, the control unit 110 detects the density using the density sensor 12. In step S18, the control unit 110 creates target density information indicating the relationship between the value of image data used in step S16 and the density of the test pattern formed using the value detected in step S17, and stores the target density information in the RAM 112. The solid line in FIG. 5 represents the target density information stored in step S18.

Figure 6:
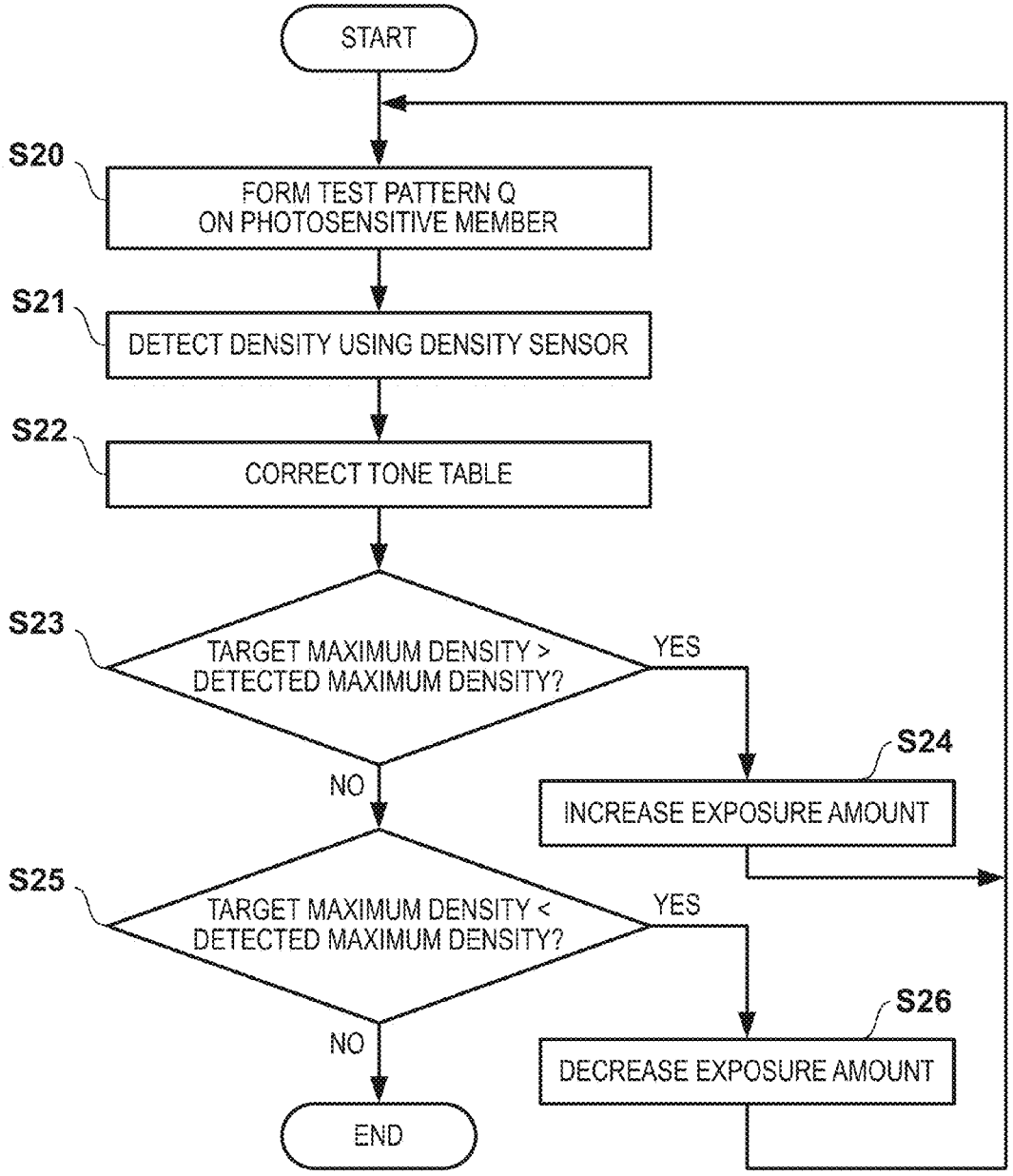
FIG. 6 is a flowchart showing correction control in the correction control mode according to an embodiment.

The correction control performed in the correction control mode using the target density information obtained in the density control is described below, with reference to FIG. 6. In step S20, the control unit 110 forms the test pattern Q shown in FIG. 2, on the photosensitive member 1. In step S21, the control unit 110 detects the density of the test pattern, from the output of the density sensor 12. In step S22, the control unit 110 corrects the tone correction table, using the target density information and the detection result in step S21. To describe this operation in more detail, the control unit 110 corrects the tone correction table so as to achieve the relationship represented by the solid line, from the detection result represented by the dotted line in FIG. 5. Further, in step S23 and step S25, the control unit 110 compares the maximum density of the target density information and the density of the solid part of the test pattern detected in step S21. When they match, the control unit 110 transitions from the correction control mode to the normal image forming mode, and starts image formation. When the maximum density of the target density information is greater than the detected density of the solid part, the control unit 110 increases the exposure amount by 1 unit in step S24. When the maximum density of the target density information is less than the detected density of the solid part, the control unit 110 decreases the exposure amount by 1 unit in step S26. In the case where the exposure amount is changed, the control unit 110 repeats the process from step S20.

The exposure amount adjustment in step S24 and step S26 is described in more detail below. Let $\alpha$ be the exposure amount, which is the maximum density condition value determined in the density control shown in FIG. 3, and $\beta$ be the exposure amount of 1 unit by which the exposure amount is increased or decreased in step S24 or step S26. In the normal image forming mode after the density control is performed, the control unit 110 performs image formation using the exposure amount $\alpha$. For the first test pattern in the first correction control mode after the density control, too, the control unit 110 forms the test pattern Q using the exposure amount $\alpha$. In the case where the exposure amount is unchanged at this stage, the control unit 110 performs image formation using the exposure amount $\alpha$ in the subsequent normal image forming mode, too. In the case where the exposure amount is changed, on the other hand, the control unit 110 forms the subsequent test pattern Q using the exposure amount $\alpha+\beta$ or $\alpha-\beta$, depending on whether the exposure amount is increased or decreased. The control unit 110 adjusts the exposure amount with the value $\beta$ as the unit, until step S23 and step S25 in FIG. 6 both result in "No" and the correction control mode ends. The control unit 110 performs the subsequent image formation operation using the exposure amount at the time of end. In the second or subsequent correction control mode, the control unit 110 forms the test pattern Q using the exposure amount at the time of start, and further corrects the exposure amount.

Figure 3:
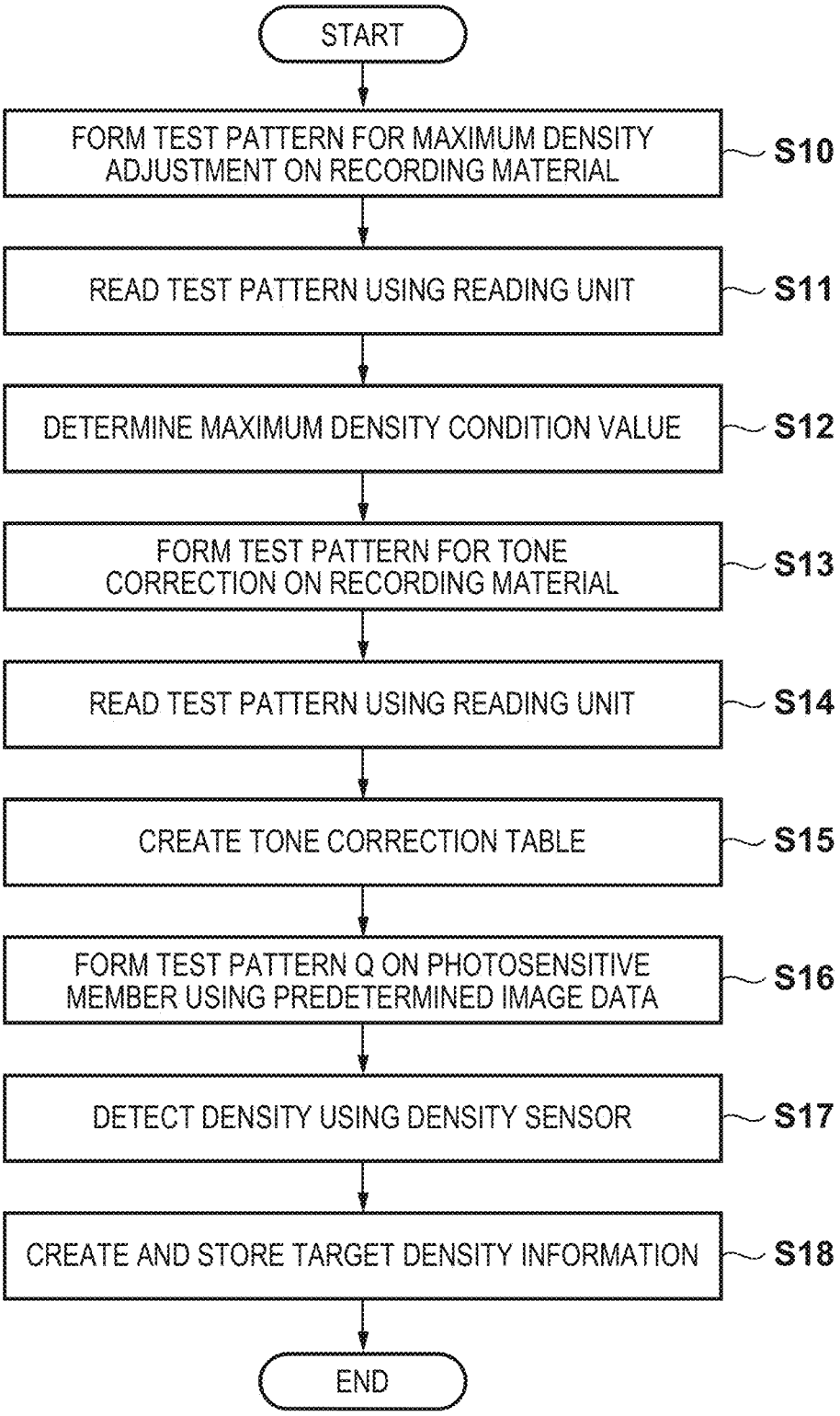
FIG. 3 is a flowchart showing density control according to an embodiment.

The following describes the range of values of the image forming condition used to form the test pattern for maximum density adjustment in step S10 in the density control shown in FIG. 3. In a conventional image forming apparatus, the test pattern shown in FIG. 4A is formed by changing the image forming condition by a fixed value in both positive and negative directions, centering on the value of the image forming condition determined by the environment condition obtained by the environment sensor 30. In this embodiment, the center is determined in consideration of the image forming condition, i.e. the exposure amount in this example, determined in the correction control mode. This is described in detail below.

Figure 7:
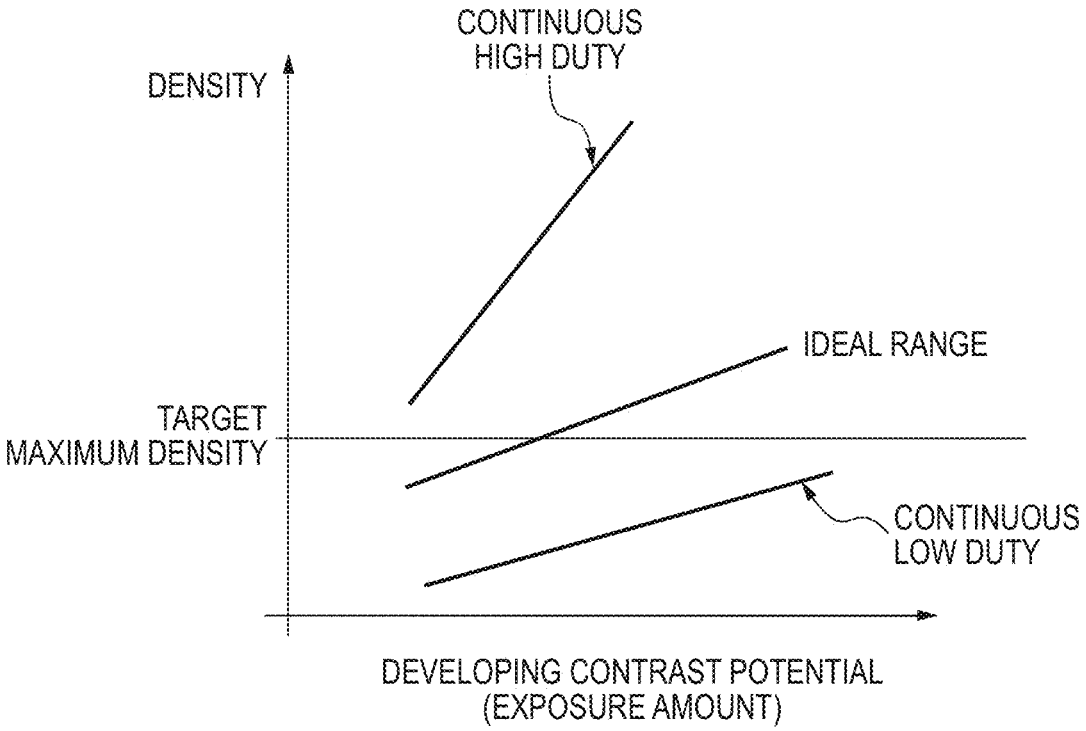
FIG. 7 is a diagram showing the relationship between the exposure amount and the density of a formed test pattern according to an embodiment.

As shown in FIG. 7, in the case where low-duty images having an image ratio of 1% or less are continuously printed, the toner charge amount increases due to friction electrification, and the density of the formed image decreases. In such a state, if the test pattern in FIG. 4A is formed while changing the image forming condition in the fixed range, the maximum density of the formed test pattern is likely to be lower than the target maximum density, as shown in FIG. 7. In the case where high-duty images having an image ratio of 80% or more are continuously printed, on the other hand, the amount of supplied toner increases and friction electrification is not sufficient, so that the toner charge amount is likely to decrease. In such a state, if the test pattern in FIG. 4A is formed while changing the image forming condition in the fixed range, the minimum density of the formed test pattern is likely to be higher than the target maximum density, as shown in FIG. 7. FIG. 7 also shows the density range of an ideal test pattern whose maximum density is higher than the target maximum density and whose minimum density is lower than the target maximum density. In this embodiment, to reduce the minimum value of the density difference between the target maximum density and the test pattern so as to be closer to the ideal state, the change range of the image forming condition is determined based on the value of the image forming condition determined in the correction control mode.

Figure 8:
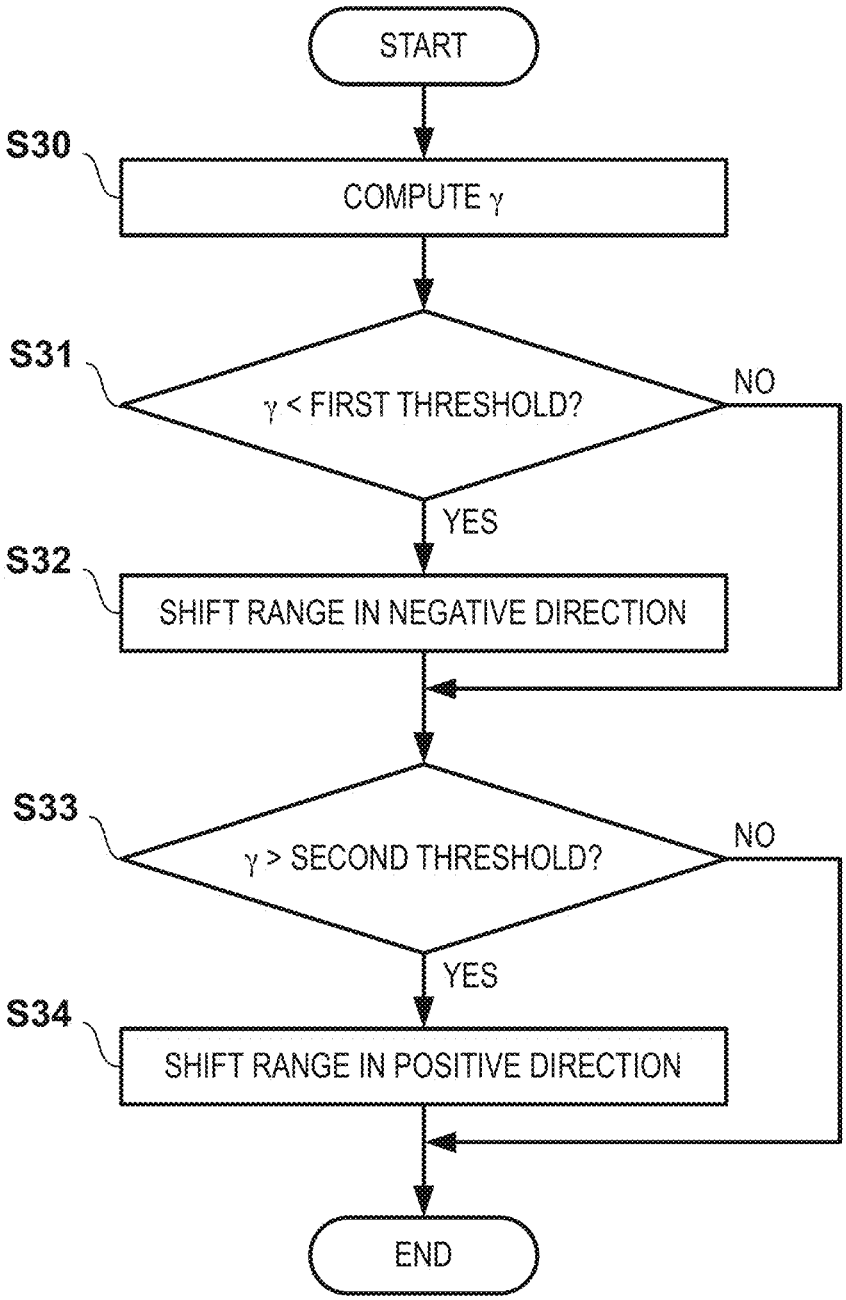
FIG. 8 is a flowchart showing a method of determining a change range of value of an image forming condition according to an embodiment.

The following describes the method of determining the change range of values of the image forming condition in the density control shown in FIG. 3, with reference to the a flowchart in FIG. 8. In the following description, let A be the exposure amount used in image formation immediately before the execution of the density control, i.e. the exposure amount determined in the latest correction control, and B be the exposure amount determined by the environment condition obtained by the environment sensor 30 in the execution of the density control. The reference change range (reference range) of the value of the image forming condition is set to "$-|X|(\%)$ to $+|X|(\%)$" with respect to the exposure amount B.

In the execution of the density control, in step S30 the control unit 110 computes a value $\gamma$ according to the following expression (1):

$$\gamma = A \times 100/B - 100(\%) \quad (1)$$

where the value $\gamma$ represents, in a percentage, the amount of increase/decrease of the exposure amount A used in image formation immediately before the execution of the density control with respect to the exposure amount B determined by the environment condition in the execution of the density control.

Figure 9:
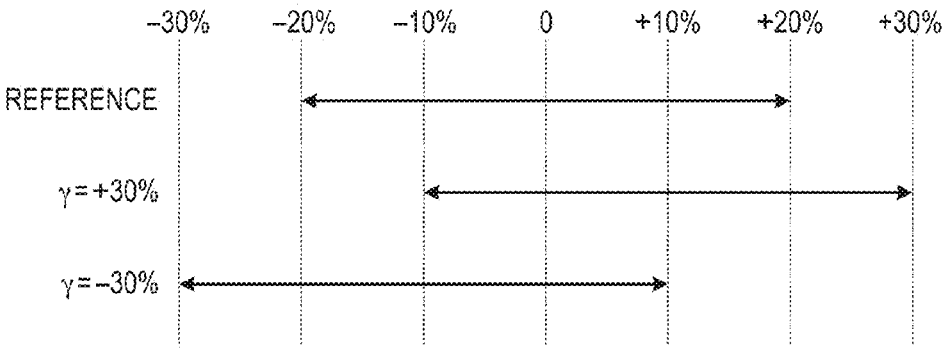
FIG. 9 is a diagram showing the change range of value of the image forming condition according to an embodiment.

In step S31, the control unit 110 compares the value $\gamma$ and a first threshold, which is a negative value. When the value $\gamma$ is less than the first threshold, the control unit 110 shifts the change range of value of the image forming condition in the negative direction in step S32. For example, in step S32, the control unit 110 may shift the change range to "$\gamma(\%)$ to $+2\times|X|-|\gamma|(\%)$", where the first threshold is $-|X|(\%)$. When the value y is greater than or equal to the first threshold, the control unit 110 compares the value y and a second threshold, which is a positive value in step S33. When the value $\gamma$ is greater than the second threshold, the control unit 110 shifts the change range of values of the image forming condition in the positive direction in step S34. For example, in step S34, the control unit 110 may shift the change range to "$-2\times|X|+|\gamma|(\%)$ to $\gamma(\%)$", where the second threshold is $+|X|(\%)$. When the results of step S31 and step S33 are both "No", the change range of the image forming condition is set to the reference range "$-|X|(\%)$ to $+|X|(\%)$". In other words, the amount of shift is 0. The change range may be shifted in a predetermined unit such as 5%. In such a case, the value $\gamma$ is rounded to the predetermined unit by round-up, round-down, round-off, or the like. FIG. 9 shows the reference change range and the shifted change ranges in the respective cases where the value y is +30(%) and −30(%), when X is 20% and the first threshold and the second threshold are respectively −20(%) and +20(%).

Figure 10A:
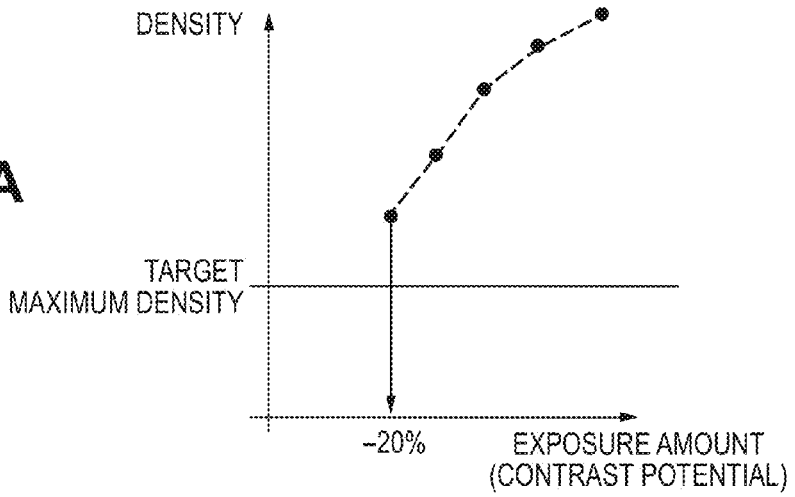
FIGS. 10A and 10B are each a diagram for describing the advantageous effects of an embodiment.
Figure 10B:
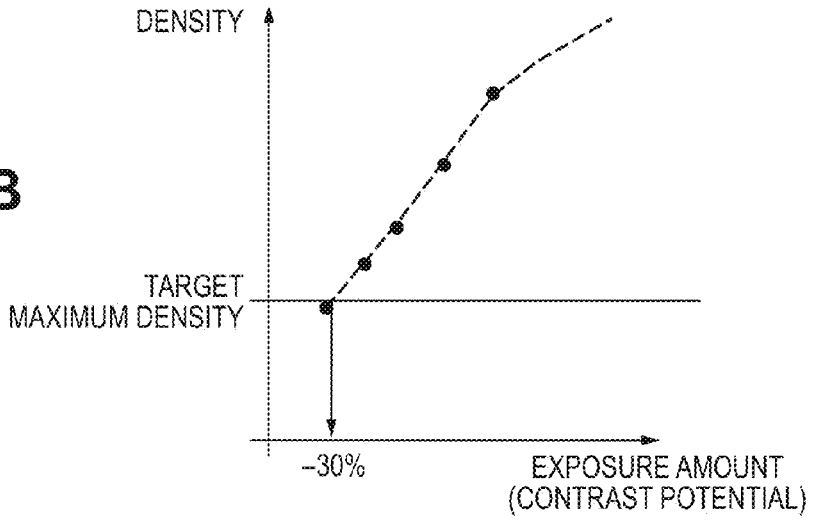
Figure 11A:
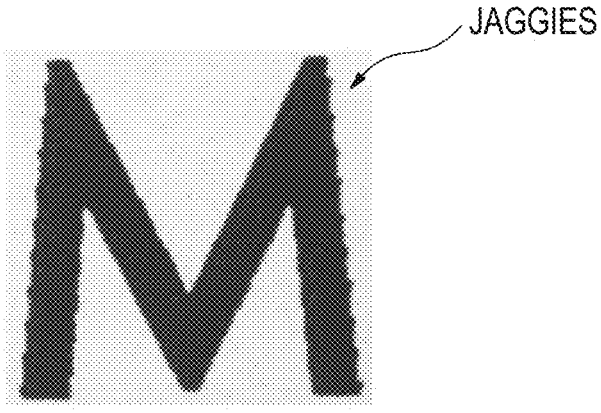
FIGS. 11A and 11B are each a diagram for describing the advantageous effects of an embodiment.
Figure 11B:
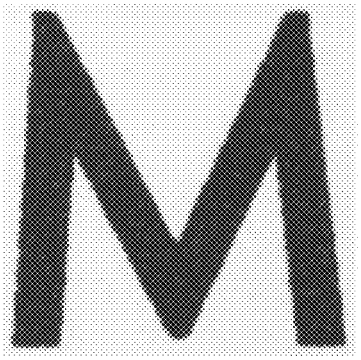

To check the advantageous effects of this embodiment, the image forming apparatus was installed in a high-temperature and high-humidity environment, and high-duty images were continuously printed. After this, the density control was executed using each of the fixed change range and the change range shifted according to this embodiment, and the results were compared. The fixed change range was set to "−20% to +20%". Since high-duty images were continuously printed in the high-temperature and high-humidity environment, each density level of the formed test pattern was higher than the target maximum density in the case of the conventional fixed change range, as shown in FIG. 10A. The tone correction was executed in this state, as a result of which the tone correction table was excessively changed to adjust to the maximum density. After this, actual printing was performed. As a result, jaggies appeared in the letter part as shown in FIG. 11A. In the case of forming the test pattern by shifting the change range, on the other hand, the density of the formed test pattern includes both higher and lower values than the target maximum density as shown in FIG. 10B, indicating that the exposure amount (developing contrast potential) to achieve the target maximum density was set properly. As a result, excessive density correction in the tone correction table is prevented. In the subsequent printing, high image quality was exhibited without jaggies as shown in FIG. 11B.

As described above, in this embodiment, the maximum density condition value is determined in the density control. After this, in the case where the correction control mode is performed at least once, in the next density control the change range of values of the image forming condition determined based on the environment condition is shifted so as to include the corrected maximum density condition value determined in the latest correction control mode. The corrected maximum density condition value in the present invention includes the case where the maximum density condition value is unchanged before and after the correction control mode. Moreover, the shifting includes the case where the change range is actually not shifted. On the other hand, in the case where the correction control mode is not performed between the time when the density control is performed and the time when the next density control is performed, the change range of the values of the image forming condition determined based on the environment condition is shifted so as to include the maximum density condition value determined when the density control is last performed. With such an arrangement, the maximum density can be appropriately adjusted in the density control, and the excessive correction of the maximum density by the subsequently created tone correction table is prevented. High image quality can thus be attained.

In this embodiment, the change range of the values of the image forming condition determined based on the environment condition is shifted so as to include the current maximum density condition value, in the density control. However, the present invention is not limited to such an arrangement. For example, with an arrangement in which the maximum density condition value immediately before the execution of the density control is compared with the center value of the change range of the values of the image forming condition determined based on the environment condition, and the change range is shifted based on the difference, the changed range need not include the maximum density condition value. To describe this process in more detail, in the case where the maximum density condition value immediately before the execution of the density control is greater than the center value of the change range of the values of the image forming condition determined based on the environment condition, the change range is shifted to increase the upper limit. In the case where the maximum density condition value immediately before the execution of the density control is less than the center value of the change range of the values of the image forming condition determined based on the environment condition, the change range is shifted to decrease the lower limit. This arrangement enables the maximum density to be adjusted appropriately in the density control, as compared with the use of the conventional fixed change range. In this embodiment, in the case where the value y is included in the change range determined by the environment condition, the change range is used without being shifted. However, the change range may be shifted to reduce the difference between the value γ and the center value of the change range determined by the environment condition, as described above with regard to the comparison with the center range.

[Embodiment 2]

Figure 12:
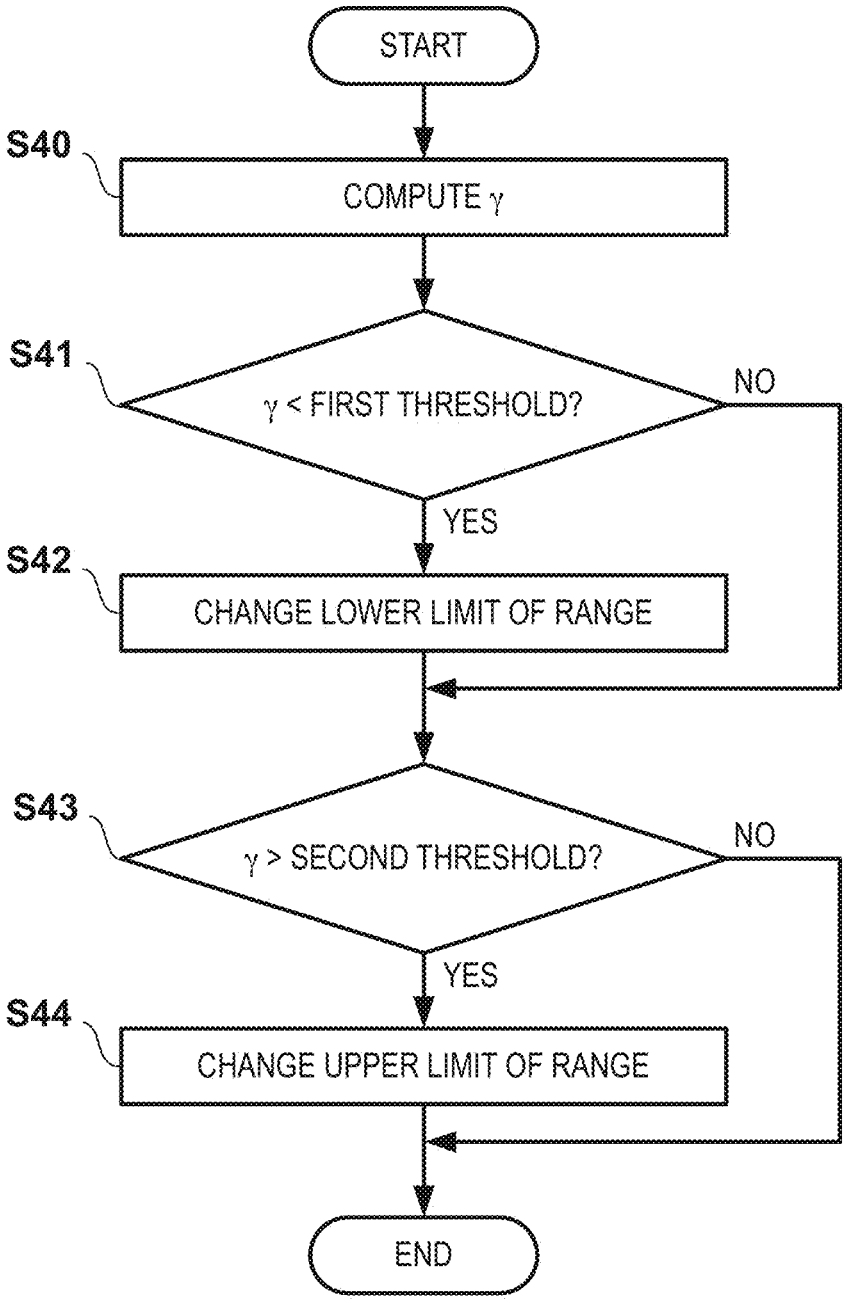
FIG. 12 is a flowchart showing a method of determining a change range of value of an image forming condition according to an embodiment.

The following describes Embodiment 2, mainly focusing on the differences from Embodiment 1. In Embodiment 1, the width of the shifted change range is the same as the width of the reference range. To describe this process in more detail, the width of the change range is the same as the width of the reference range, i.e. 2×|X|(%), regardless of whether or not the change range is shifted. However, in the case where, despite a significant change in the state of the image forming apparatus resulting from component replacement or the like before the execution of the density control, the shift is performed in the density control based on the exposure amount before the component replacement, an appropriate change range of the image forming condition may not be able to be obtained. Suppose, in a state where the value γ exceeds the second threshold as a result of continuous printing of low-duty images, the developing unit 4 is replaced, causing the toner charge amount to decrease from the amount before the replacement. The density control performed in such a state shifts the change range in the positive direction, but there is a possibility that all density levels of the formed test pattern are higher than the target maximum density, because the toner charge amount is lower. In this embodiment, when the value γ is less than the first threshold, only the lower limit of the change range is changed while maintaining the upper limit at the reference level. Likewise, when the value γ is greater than the second threshold, only the upper limit of the change range is changed, while maintaining the lower limit at the reference level. FIG. 12 is a flowchart of the method of determining the change range of the image forming condition according to this embodiment. The differences from Embodiment 1 shown in FIG. 8 are the following: when the value γ is less than the first threshold, the control unit 110 changes only the lower limit of the change range, while maintaining the upper limit at the reference level in step S42; and when the value γ is greater than the second threshold, the control unit 110 changes only the upper limit of the change range, while maintaining the lower limit at the reference level in step S44. For example, suppose the reference change range is "−|X|(%) to +|X|(%)", as in Embodiment 1. In this case, in step S42, the control unit 110 sets the change range to "γ(%) to +|X|(%)". Likewise, in step S44, the control unit 110 sets the change range to "−|X|(%) to γ(%)". The unit of change may be a predetermined unit such as 5%, as in Embodiment 1.

As described above, according to this embodiment, the change range of the values of the image forming condition determined based on the environment condition is widened so as to include the maximum density condition value determined in the latest correction control mode, in the density control. With such an arrangement, even in the case where, after the density-related image forming condition such as the exposure amount is determined in the correction control mode, the state of the image forming apparatus changes significantly as a result of component replacement or being left for a long time before the next density control operation is executed, the maximum density can be adjusted accurately.

[Embodiment 3]

In Embodiments 1 and 2, the lower limit of the change range is set to the value γ when the value γ is less than the first threshold, and the upper limit of the change range is set to the value γ when the value γ is greater than the second threshold. Moreover, the problem and its solution in the case where the direction of the change of the image forming condition determined last in the correction control mode with respect to the reference range is opposite to the direction in which the state of the image forming apparatus changes as a result of being left for a long time or the like are described in Embodiment 2. However, there is also a possibility that the direction of the change of the image forming condition determined last in the correction control mode with respect to the reference range is the same as the direction in which the state of the image forming apparatus changes as a result of being left for a long time or the like. Hence, in this embodiment, the lower limit of the change range is set to "$\gamma-|\sigma|$" when the value γ is less than the first threshold, and the upper limit of the change range is set to "$\gamma+|\sigma|$" when the value γ is greater than the second threshold. The value σ is a predetermined value stored in the ROM 113 or the RAM 112. The value σ may be different between the time when changing the lower limit and the time when changing the upper limit. With such an arrangement, even in the case where, after the execution of the correction control mode, the state of the image forming apparatus changes significantly as a result of component replacement or being left for a long time before the density control, the maximum density can be adjusted accurately.

[Embodiment 4]

In Embodiments 1 to 3, the test pattern formed on the recording material is read by the reading unit 216 to perform the density control. Alternatively, the test pattern may be formed on the photosensitive member 1 or the intermediate transfer belt 6, which is an image carrier, to perform the density control operation. In this case, for example, the density control may be automatically performed each time a predetermined number of sheets are printed. In the case where the test pattern is formed on the photosensitive member 1, the density sensor 12 detects the density in the density control. In the case where the test pattern is formed on the intermediate transfer belt 6, a density sensor for detecting the test pattern on the intermediate transfer belt 6 is provided to detect the density in the density control. According to this embodiment, the density control can be appropriately executed without consuming the recording material. In Embodiments 1 to 3, the test pattern formed on the recording material is placed on the platen 102 by the user and read. Alternatively, a density sensor for measuring the density of the image on the recording material conveyed through the conveyance path after the fixture may be provided to detect the density.

[Other embodiments]

In each of the embodiments described above, the definition of the change range of the value of the image forming condition in the density control and the comparison of increase/decrease between the maximum density condition value and the exposure amount determined by the environment condition in the density control are made in percentages. Alternatively, the comparison of increase/decrease and the definition of the change range centering on the exposure amount determined by the environment condition may be made using actual values.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-222683, filed on Oct. 25, 2013 which is hereby incorporated by reference herein in its entirety.

What is claimed is:

1. An image forming apparatus comprising:

an image forming unit configured to form an image according to a process condition;

a measurement unit configured to measure a measurement image formed by the image forming unit;

an update unit configured to cause the image forming unit to form a first measurement image, to cause the measurement unit to measure the first measurement image, and to update the process condition based on a result of the measurement of the first measurement image by the measurement unit;

a first determination unit configured to cause the image forming unit to form a plurality of second measurement images, to cause the measurement unit to measure the plurality of second measurement images, and to determine the process condition based on a result of the measurement of the plurality of second measurement images by the measurement unit, the plurality of second measurement images being formed according to a plurality of test process conditions;

an obtaining unit configured to obtain environment information; and a second determination unit configured to determine the plurality of test process conditions, based on the environment information obtained by the obtaining unit and the process condition updated by the update unit, wherein the image forming unit includes:

a photosensitive member;

a charging unit configured to charge the photosensitive member;

an exposure unit configured to expose the photosensitive member charged by the charging unit, to form an electrostatic latent image; and a developing unit configured to develop the electrostatic latent image to form the image, wherein the process condition is the light intensity of light irradiating the photosensitive member by the exposure unit, and wherein the test process conditions are the light intensities of light irradiating the photosensitive member by the exposure unit, wherein the second determination unit is configured to determine a first range of the light intensity based on the environment information obtained by the obtaining unit and, in the case where the light intensity updated by the update unit is higher than an upper limit of the first range, the second determination unit determines a plurality of light intensities based on a second range, each of the plurality of light intensities is included in the second range, and the upper limit of the second range is higher than the upper limit of the first range.

2. An image forming apparatus comprising:

an image forming unit configured to form an image according to a process condition;

a measurement unit configured to measure a measurement image formed by the image forming unit;

an update unit configured to cause the image forming unit to form a first measurement image, to cause the measurement unit to measure the first measurement image, and to update the process condition based on a result of the measurement of the first measurement image by the measurement unit;

a first determination unit configured to cause the image forming unit to form a plurality of second measurement images, to cause the measurement unit to measure the plurality of second measurement images, and to determine the process condition based on a result of the measurement of the plurality of second measurement images by the measurement unit, the plurality of second measurement images being formed according to a plurality of test process conditions;

an obtaining unit configured to obtain environment information; and a second determination unit configured to determine the plurality of test process conditions, based on the environment information obtained by the obtaining unit and the process condition updated by the update unit, wherein the image forming unit includes:

a photosensitive member;

a charging unit configured to charge the photosensitive member;

an exposure unit configured to expose the photosensitive member charged by the charging unit, to form an electrostatic latent image; and a developing unit configured to develop the electrostatic latent image to form the image, wherein the process condition is the light intensity of light irradiating the photosensitive member by the exposure unit, wherein the test process conditions are the light intensities of light irradiating the photosensitive member by the exposure unit, wherein the second determination unit is configured to determine a first range of the light intensity based on the environment information obtained by the obtaining unit and, in the case where the light intensity updated by the update unit is lower than the lower limit of the first range, the second determination unit determines a plurality of light intensities based on a second range, each of the plurality of light intensities is included in the second range, and the lower limit of the second range is lower than the lower limit of the first range.

3. The image forming apparatus according to claim 1, wherein the second determination unit is configured to determine a first range of the light intensity based on the environment information obtained by the obtaining unit and, in the case where the light intensity updated by the update unit is in the first range, the second determination unit determines a plurality of light intensities based on the first range, and each of the plurality of light intensities is included in the first range.

4. The image forming apparatus according to claim 1, wherein the image forming unit is configured to form the first measurement image according to the process condition determined by the first determination unit.

5. The image forming apparatus according to claim 1, wherein the image forming unit is configured to form the first measurement image according to the process condition determined by the first determination unit, at a first timing after the process condition is determined by the first determination unit, and wherein the update unit is configured to update the process condition, based on a first measurement result of the measurement unit for the first measurement image formed by the image forming unit at the first timing and a second measurement result of the measurement unit for the first measurement image formed by the image forming unit at a second timing after the first timing.

6. The image forming apparatus according to claim 5, wherein the first measurement image is formed according to the process condition last updated by the update unit.

7. The image forming apparatus according to claim 1, wherein the image forming unit includes an image carrier, and is configured to transfer the image formed on the image carrier to a recording material, and wherein the measurement unit includes: a first measurement unit configured to measure the first measurement image formed on the image carrier; and a second measurement unit configured to measure the plurality of second measurement images formed on the recording material.

8. The image forming apparatus according to claim 7, wherein the second measurement unit is a reading unit configured to read the plurality of second measurement images formed on the recording material, and wherein the first determination unit is configured to determine the process condition, based on read data of the plurality of second measurement images read by the reading unit.

9. The image forming apparatus according to claim 2, wherein in the case where the light intensity updated by the update unit is in the first range, the second determination unit determines a plurality of light intensities based on the first range, and each of the plurality of light intensities is included in the first range.

10. The image forming apparatus according to claim 2, wherein the image forming unit is configured to form the first measurement image according to the process condition determined by the first determination unit.

11. The image forming apparatus according to claim 2, wherein the image forming unit is configured to form the first measurement image according to the process condition determined by the first determination unit, at a first timing after the process condition is determined by the first determination unit, and wherein the update unit is configured to update the process condition, based on a first measurement result of the first measurement image formed by the image forming unit at the first timing and a second measurement result of the first measurement image formed by the image forming unit at a second timing after the first timing.

12. The image forming apparatus according to claim 11, wherein the first measurement image is formed according to the process condition last updated by the update unit.

13. The image forming apparatus according to claim 2, wherein the image forming unit includes an image carrier, and is configured to transfer the image formed on the image carrier to a recording material, and wherein the measurement unit includes:

a first measurement unit configured to measure the first measurement image formed on the image carrier; and a second measurement unit configured to measure the plurality of second measurement images formed on the recording material.

14. The image forming apparatus according to claim 13, wherein the second measurement unit is a reading unit configured to read the plurality of second measurement images formed on the recording material, and wherein the first determination unit is configured to determine the process condition, based on read data of the plurality of second measurement images read by the reading unit.

* * * * *